US005465565A

United States Patent [19]

Tsuzuki

[11] Patent Number: 5,465,565

[45] Date of Patent: * Nov. 14, 1995

[54] APPARATUS AND METHOD FOR DELIVERY OF SLIVER TO RINGLESS SPINNING MACHINE

[75] Inventor: Kiyohiro Tsuzuki, Greenville, S.C.

[73] Assignee: TNS Mills, Greenville, S.C.

[ * ] Notice: The portion of the term of this patent subsequent to Aug. 2, 2011, has been disclaimed.

[21] Appl. No.: 217,375

[22] Filed: Mar. 24, 1994

Related U.S. Application Data

[63] Continuation-in-part of Ser. No. 134,461, Oct. 8, 1993, Pat. No. 5,333,440, which is a continuation of Ser. No. 934,877, Aug. 21, 1992, abandoned.

[51] Int. Cl.[6] ..... D01H 13/04

[52] U.S. Cl. ..... 57/90; 57/315

[58] Field of Search ..... 57/90, 315, 308, 57/408

[56] References Cited

U.S. PATENT DOCUMENTS

| | | | |
|---|---|---|---|
| 3,070,948 | 1/1963 | Tsuzuki | 57/308 |
| 3,469,385 | 9/1969 | Tsuzuki | 57/308 |
| 3,564,829 | 2/1971 | Tsuzuki | 68/5 DX |
| 3,650,104 | 3/1972 | Shepherd et al. . | |
| 3,787,615 | 1/1974 | Foerster et al. . | |
| 3,816,991 | 6/1974 | Takeuchi et al. | 57/90 |
| 4,022,007 | 5/1977 | Motobayashi et al. | 57/308 X |
| 4,098,065 | 7/1978 | Stahlecker et al. . | |
| 4,150,530 | 4/1979 | Derichs . | |
| 4,497,168 | 2/1985 | Kamp . | |
| 4,590,757 | 5/1986 | Stahlecker . | |
| 4,607,485 | 8/1986 | Stahlecker . | |
| 4,922,707 | 5/1990 | Meroni et al. . | |
| 4,932,201 | 6/1990 | Meroni et al. . | |
| 4,939,895 | 7/1990 | Raasch et al. . | |
| 5,333,440 | 8/1994 | Tsuzaki | 57/90 |

*Primary Examiner*—Joseph J. Hail, III

*Attorney, Agent, or Firm*—Hardaway Law Firm

[57] ABSTRACT

A plant structure having three floors with first and second ringless spinning apparatuses located on the first floor and with vertical sliver feed tubes extending from the first and second ringless spinning apparatuses respectively to the second floor for feeding a sliver through the sliver feed tube to the first ringless spinning apparatus and to the third floor for feeding sliver from a can thereof to said second ringless spinning apparatus.

10 Claims, 3 Drawing Sheets

APPARATUS AND METHOD FOR DELIVERY OF SLIVER TO RINGLESS SPINNING MACHINE

RELATED APPLICATION DATA

This application is a continuation-in-part of application Ser. No. 08/134,461, filed Oct. 8, 1993, now U.S. Pat. No. 5,333,440 which is a continuation of application Ser. No. 07/934,877, filed Aug. 21, 1992, now abandoned.

BACKGROUND OF THE INVENTION

This invention relates generally to the art of textiles and more particularly to a plant structure for the spinning of textile fibers into yarn products.

Various plant structures have existed for the production of textile yarns for ultimately weaving or knitting into desired fabric.

Traditionally, two techniques of spinning have been utilized, i.e. ring spinning and open-end spinning. An example of open-end spinning is described in U.S. Pat. No. 4,939,895 to Raasch, et al. assigned to W. Schlafhorst & Co. of Germany. As described in this particular patent cans of coiled sliver typically are positioned on the floor adjacent to an open-end spinning apparatus and vertically bent upwardly into the open-end spinning apparatus.

An example of an open-end spinning apparatus is the Autocoro 240 automatic rotor spinning and winding machine produced and sold by W. Schlafhorst & Co.

While plants have effectively operated utilizing the arrangement as above described, room exists for improvement in the overall plant operations utilizing ringless spinning devices, i.e., open-end spinning devices and air jet spinning devices.

SUMMARY OF THE INVENTION

It is thus an object of this invention to provide a novel plant arrangement of a ringless spinning apparatus.

It is a further and more particular object of this invention to provide such a novel ringless spinning apparatus arrangement wherein the number of such ringless spinning apparatuses may be maximized per square foot of the floor maintaining such apparatus.

It is a further and more particular object of this invention to provide a novel apparatus for feeding a sliver to a ringless spinning apparatus.

It is a further and yet more particular object of this invention to provide a novel plant structure for housing such ringless spinning apparatus.

These as well as other objects are accomplished by a plant structure comprising a building structure having first, second and third floors therein, first and second ringless spinning apparatuses located adjacent one another on the first floor, a first sliver feed tube on the second floor for directing sliver from a can located on the second floor to the first ringless spinning apparatus, and a second sliver feed tube extending from the third floor to the second ringless spinning apparatus for directing sliver from a can located on the third floor to the second ringless spinning apparatus. Each of the sliver feed tubes has a vertical portion and an obtuse portion forming an obtuse angle with the vertical portion proximate a lower end of the vertical portion such that the sliver travels downwardly through the vertical portion and then through the obtuse portion.

DETAILED DESCRIPTION

In accordance with this invention it has been found that a plant housing apparatus for the ringless spinning of textile fibers into yarns may be operated with considerably greater efficiency both from the space standpoint and from the man hours standpoint by locating the ringless spinning apparatuses on the first floor of an at least three story plant structure and by feeding sliver to the spinning apparatuses alternately from the second and third floors of the plant facility. Sliver feed tubes are provided to appropriately direct the sliver from the second and third stories to adjacent spinning apparatuses. Various other advantages and features will become apparent from the following description given with reference to the various figures of drawings.

Figure 1:
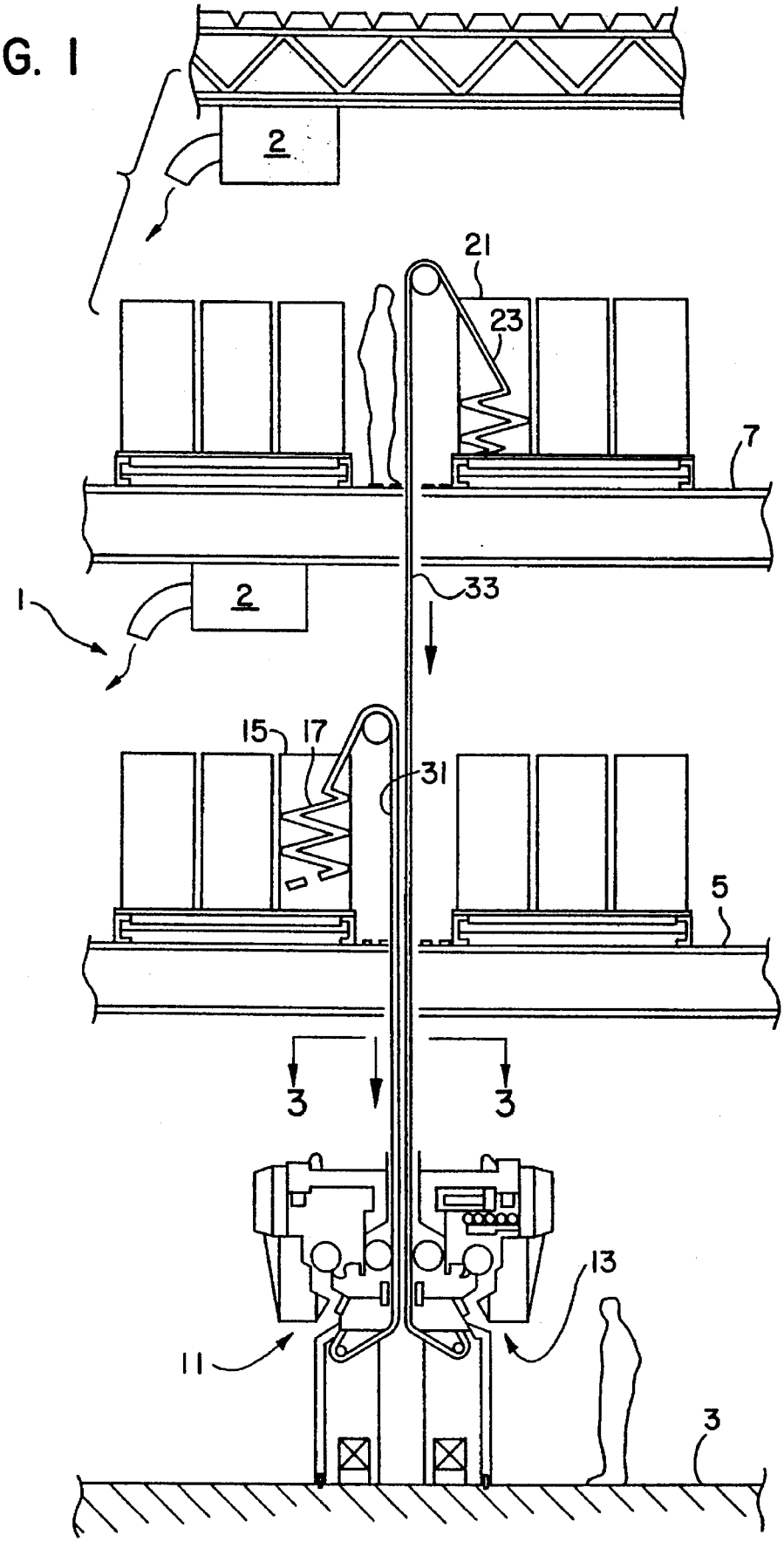
FIG. 1 of the drawings illustrates a plant structure in accordance with this invention.

FIG. 1 of the drawings illustrates generally a plant structure 1 having a first floor 3, a second floor 5 and a third floor 7. Located on the first floor or ground floor 3 are first and second open-end spinning apparatuses 11 and 13. Such apparatuses 11 and 13 may be of the type described in U.S. Pat. No. 4,939,895 referenced above and which is hereby incorporated by reference and may also be of the type marketed by Schlafhorst as the Autocoro 240.

Located on the second floor 5 are a plurality of cans referenced as 15 containing sliver 17 spiralled therein. Sliver 17 is formed by techniques known in the textile art for the cleaning and opening of textile fibers such as cotton.

The third floor 7 contains an arrangement similar to the second floor 5 having cans such as 21, also having sliver 23 coiled therein.

The arrangement in accordance with this invention of utilizing sliver cans on the second and third floors permit the second and third floors to have very tightly controlled temperature and humidity conditions so as to have a sliver properly conditioned for the open end-spinning process. This is achieved by the use of conventional air conditioners 2 located on the second or third floors. There are significant efficiency and energy savings associated with the maintenance of the sliver containers in the second and third floor configuration of this invention. The first floor 3, housing the open end spinning apparatuses 11, 13, is maintained at a different temperature and humidity which is more appropriate for spinning. It has been found to be highly advantageous to separately maintain the sliver at an optimum conditioning temperature while spinning at a different but optimum spinning temperature and humidity.

The conventional can is normally at a maximum of twenty inches by forty-eight inches, which does not allow a significant amount of sliver in each can and requires significant and frequent replacement. According to this invention, however, thirty inch by fifty inch cans 15 can be utilized, thus accomodating more sliver and requiring considerably less frequent changing of the cans 15.

Sliver feed tubes 31 and 33 extend respectively from the second floor 5 and the third floor 7 to appropriately direct the sliver to open-end spinning apparatuses 11 and 13. As shown in FIG. 1, it is seen that the sliver feed tubes pass through the floor structures of the second and third floors S and 7. The sliver feed tubes may be immediately adjacent a sliver can or may terminate just above the appropriate floor structure.

Figure 2:
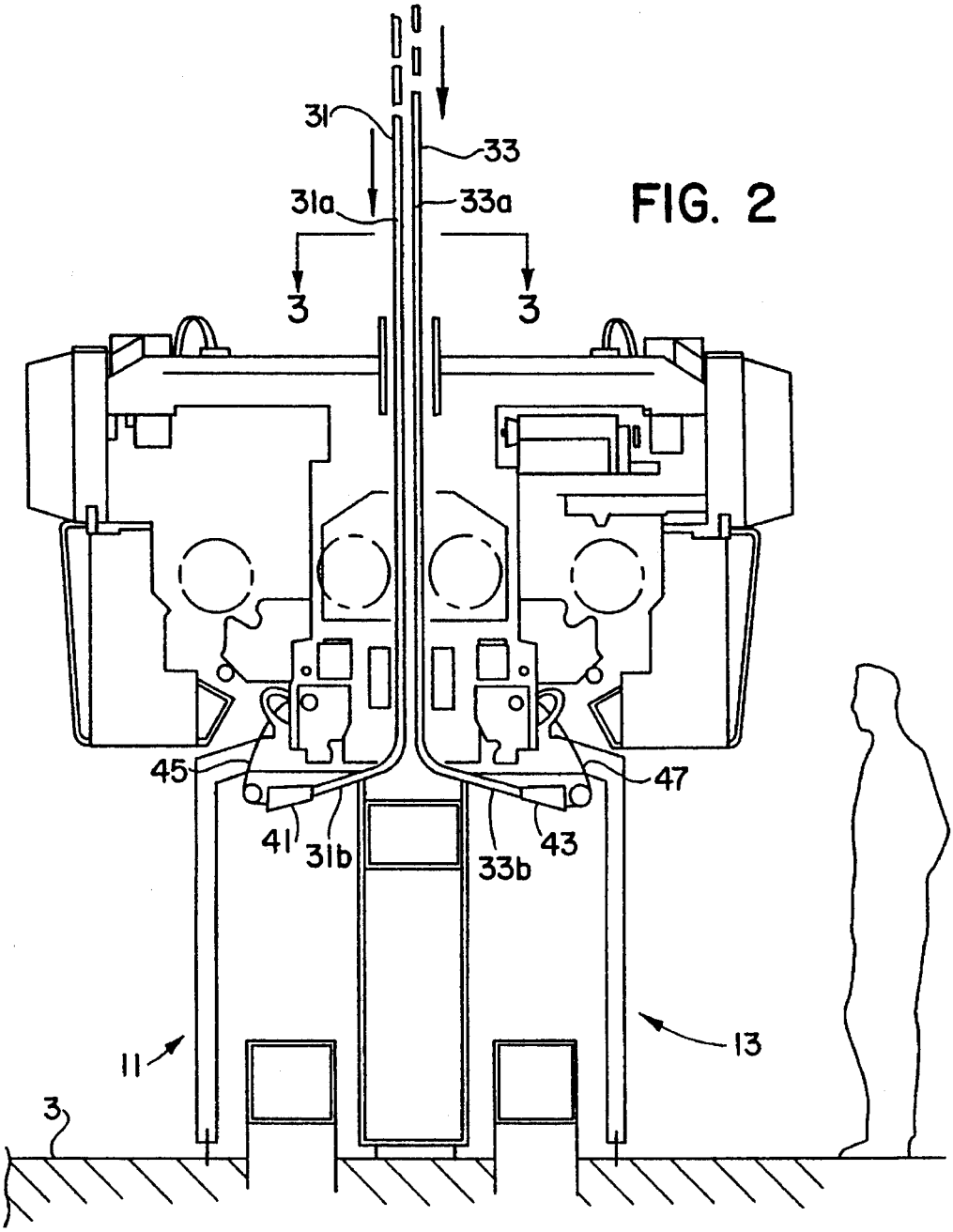
FIG. 2 of the drawings schematically illustrates the feeding of an open-end spinning apparatus in accordance with this invention.

Referring to FIG. 2 of the drawings, which is shown in greater detail with regard to the first floor structure, it is seen that the sliver feed tubes 31 and 33 each respectively include vertical portions 31*a*, 33*a* extending vertically downwardly, obtuse portions 31*b*, 33*b* extending at an obtuse angle to the vertical portions 31*a*, 33*a*, and horizontal end portions 41, 43. Thus, in either tube, sliver travels through a vertical portion, an obtuse portion, and a horizontal end portion, at which point the sliver is exposed and fed upwardly to the intake of the spinning apparatus. Utilizing this construction, no modification of the spinning apparatus is required and generally the spinning apparatus still receives the sliver in the same manner that it would receive a sliver if it were fed directly from a can thereof placed on the ground floor 3.

The sliver feed tube utilized in accordance with this invention is generally a smooth, hollow construction and preferably is made transparent so that the movement of the sliver through the tube may be visually observed.

It is critical to this invention to have the sliver descend through the tubes without any breakage. The tube must be of sufficient diameter to permit the sliver to pass down in a snake-like fashion without significant rubbing on the walls of the tube. The tube walls also include an anti-static agent to prevent sticking should contact occur.

Figure 3:
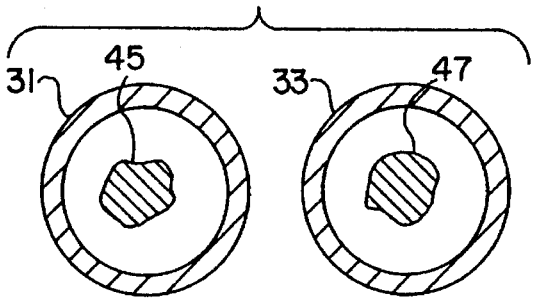
FIG. 3 of the drawings is a cross-sectional view along the line 3—3 of FIG. 1.

Referring to FIG. 3 of the drawings, sliver feed tubes 31 and 33 are illustrated in cross-section and have respectively sliver 45 and 47 passing therethrough. It should be noted that the interior surface of the sliver feed tubes 31 and 33 should be very smooth so as to not snag sliver passing therethrough. A material possessing the requisite characteristics of smoothness is generally an extruded tubing formed from polyvinyl chloride (PVC), which is the type of material normally utilized for beverage containers.

Figure 4:
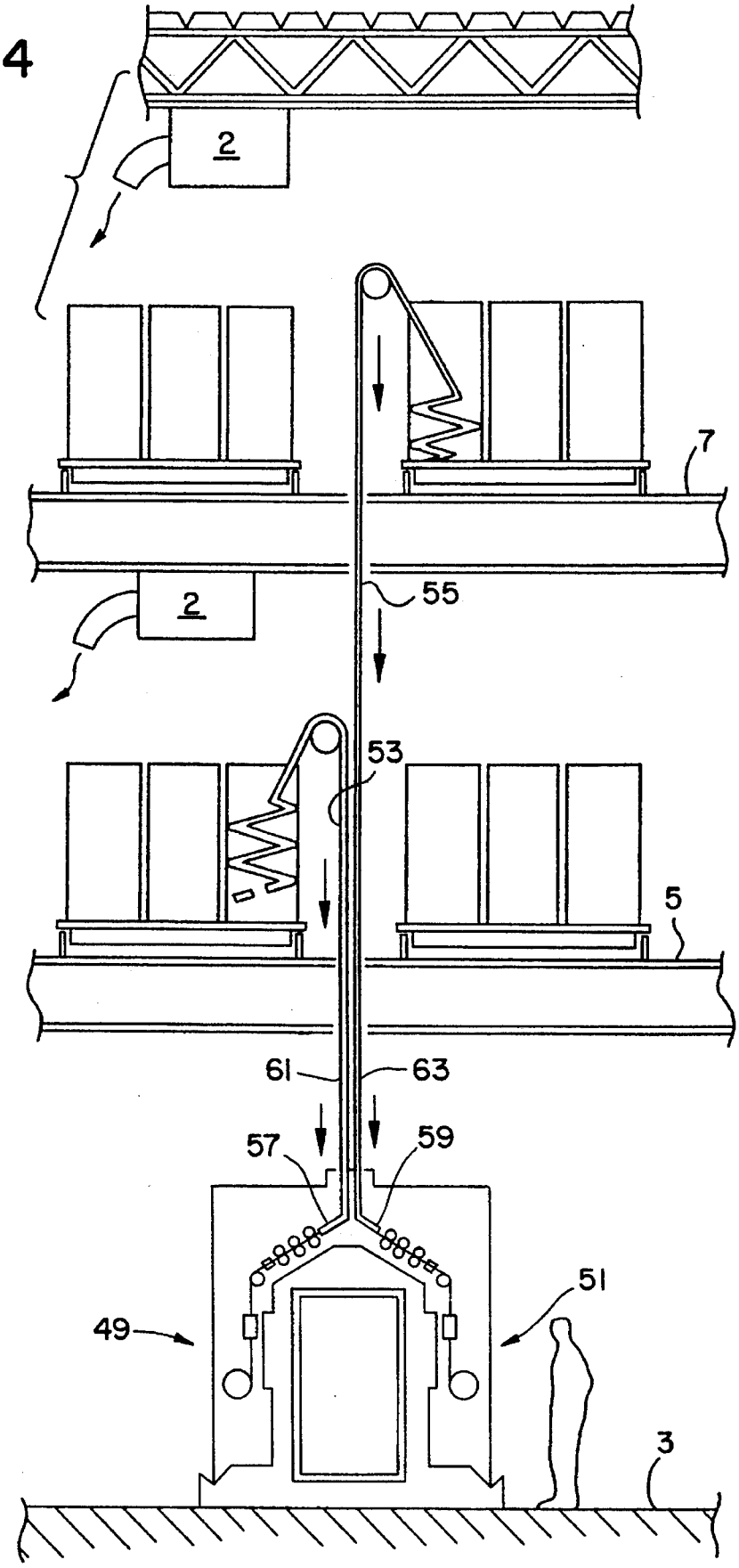
FIG. 4 of the drawings schematically illustrates the feeding of an air jet spinning apparatus in accordance with this invention.

FIG. 4 of the drawings is similar to FIG. 1, except that: (1) first and second air jet spinning apparatuses 49 and 51, respectively, substitute for the first and second open-end spinning apparatuses 11 and 13, and (2) the shape of the sliver feed tubes vary slightly from that previously described. Apparatuses 49 and 51 may be of the type marketed by Murata Machinery, Ltd. of Osaka, Japan under Model No. 802H MJS.

Sliver feed tubes 53, 55 respectively extend vertically downwardly from the second floor 5 and the third floor 7 in the same manner discussed with regard to tubes 31 and 33 and bend proximate their outlet ends in a manner similar to that shown in FIG. 2. Specifically, sliver feed tubes 53, 55 have an obtuse portion 57, 59, respectively, proximate their lower ends making an obtuse angle with their respective vertical portions 61, 63. Sliver strands are thereby directed in the vertical portions 61, 63 of each tube 53, 55 vertically downwardly from their associated drawing cans and are then directly fed downwardly through respective obtuse portions 57, 59 into air jet spinning apparatuses 49 and 51, respectively.

Unlike tubes 31 and 33, tubes 53 and 55 have no horizontal portion due to the angle at which sliver customarily enters an air jet spinning apparatus, i.e. at an angle obtuse to a vertical portion of a sliver feed tube. As shown in FIG. 4, sliver strands exit obtuse portions 57, 59 and are directly fed downwardly into associated draft units of first and second air jet spinning apparatuses 49 and 51. Thus, like the open-end spinning machines 11 and 13 (FIG. 2), no modification of the air jet spinning apparatuses 49 and 51 will be necessary prior to their use in conjunction with this embodiment of the present invention.

It is thus seen that this invention provides a novel plant structure for the ringless spinning of textile fibers into yarns. It is seen that such plant structure maximizes efficiency with regard to space utilization and worker accessibility to machinery. As many variations will become apparent to those of skill in the art, such variations are embodied within the spirit and scope of this invention as measured by the following appended claims.

That which is claimed:

1. In a ringless spinning apparatus having means to receive sliver for the spinning thereof into yarn, the improvement comprising:

a sliver feed tube for feeding sliver to said ringless spinning apparatus, said sliver originating from a sliver source disposed two floors above said ringless spinning apparatus;

said sliver feed tube having a vertical portion and a straight obtuse portion forming an obtuse angle with said vertical portion at a lower end of said vertical portion such that said sliver travels downwardly through said vertical portion and then through said straight obtuse portion; and wherein said sliver feed tube includes a horizontal portion following said straight obtuse portion, such that said sliver travels downwardly through said vertical portion, through said straight obtuse portion, and then through said horizontal portion.

2. In a ringless spinning apparatus according to claim 1 wherein said sliver feed tube is made from an extruded material.

3. In a ringless spinning apparatus according to claim 2 wherein said extruded material is PVC.

4. In a ringless spinning apparatus according to claim 1 wherein an inside of said sliver feed tube is coated with an anti-static agent.

5. In a ringless spinning apparatus according to claim 1 wherein said sliver feed tube is unobstructed at all points inside its core and at both its ends.

6. A plant structure for the treatment of textile fibers to form such fibers as yarn, comprising:

a building structure having first, second and third floors therein;

first and second ringless spinning apparatuses located adjacent one another on said first floor;

a first sliver feed tube on said second floor for directing sliver from a can located on said second floor to said first ringless spinning apparatus; and a second sliver feed tube extending from said third floor to said second ringless spinning apparatus for directing sliver from a can located on said third floor to said second ringless spinning apparatus;

each of said sliver feed tubes having a vertical portion and a straight obtuse portion forming an obtuse angle with said vertical portion at a lower end of said vertical portion such that said sliver travels downwardly through said vertical portion and then through said straight obtuse portion; and wherein each of said sliver feed tubes has a horizontal portion following said obtuse portion, such that said sliver travels downwardly through said vertical portion, through said obtuse portion, and then through said horizontal portion.

7. A plant structure for the treatment of textile fibers according to claim 6 wherein said first and second sliver feed tubes are unobstructed at all points inside their cores and at all their respective ends.

8. A plant structure for the treatment of textile fibers according to claim 6 wherein an inside of said first and second sliver feed tubes are coated with an anti-static agent.

9. A plant structure for the treatment of textile fibers according to claim 6 wherein said first and second sliver feed tubes are made from an extruded material.

10. A plant structure for the treatment of textile fibers according to claim 9 wherein said extruded material is PVC.

* * * * *